United States Patent [19]

Ashworth

[11] 4,294,188

[45] Oct. 13, 1981

[54] HYDRAULICALLY OPERATED ACCESS EQUIPMENT

[75] Inventor: Denis H. Ashworth, Dudley, England

[73] Assignee: Simon Engineering Dudley Limited, West Midlands, England

[21] Appl. No.: 78,183

[22] Filed: Sep. 24, 1979

Related U.S. Application Data

[63] Continuation of Ser. No. 824,822, Aug. 15, 1977, abandoned.

[30] Foreign Application Priority Data

Aug. 21, 1976 [GB] United Kingdom ..... 34923/76

[51] Int. Cl.[3] ..... B05C 5/00

[52] U.S. Cl. ..... 118/305; 15/93 R; 114/222; 118/323

[58] Field of Search ..... 118/207, 305, 323; 114/222; 51/424; 15/53 A, 93 R; 182/2; 239/165, 166; 134/45

[56] References Cited

U.S. PATENT DOCUMENTS

| | | | |
|---|---|---|---|
| 2,628,456 | 2/1953 | Berg | 51/424 |
| 3,623,902 | 11/1971 | Hammelmann | 118/305 X |
| 3,775,798 | 12/1973 | Thornton-Trump | 15/53 A |
| 3,951,092 | 4/1976 | van den Broek | 118/305 X |

*Primary Examiner*—John P. McIntosh

*Attorney, Agent, or Firm*—Norris & Bateman

[57] ABSTRACT

Equipment for cleaning hulls of ships and like surfaces, including a vehicle carrying an articulated boom structure comprising one or more booms connected to the vehicle and rotatable about a turntable thereon, and elevatable relative thereto, the outermost end of the boom structure carrying a frame or the housing which contains a nozzle or like for cleaning or applying coatings to the surface to be treated, the frame or housing including rollers for running along the that surface in contact therewith and the turntable drive being capable of being so rotationally biased that the rollers are positively maintained in engagement with the surface being cleaned.

8 Claims, 4 Drawing Figures

HYDRAULICALLY OPERATED ACCESS EQUIPMENT

This is a continuation of application Ser. No. 824,822, filed Aug. 15, 1977, now abandoned.

This invention concerns hydraulically operated access equipment of the kind (hereinafter termed of the kind referred to) comprising an articulated boom structure having a boom, or a plurality of booms pivotally interconnected end-to-end or telescopically extendible, the boom or the lowermost boom being pivotally mounted at one end on a supporting structure such as a vehicle, there being hydraulic actuating means whereby the boom structure may be moved between a generally horizontal stowed position, and an elevated position wherein its outermost end is raised above said supporting structure.

It is now proposed to use hydraulically operated access equipment of the kind referred to for providing access to a surface such as the hull of a ship when in dry dock, and having means for cleaning same or for applying coatings thereto.

According to the present invention, there is provided hydraulically operated access equipment of the kind referred to, comprising a frame or housing connected to said boom structure at the outermost end thereof; further means connected to the frame or housing for cleaning or applying coatings to an adjacent surface; surface engaging means connected to the frame or housing to maintain same at a fixed distance from said surface when the equipment is in use and as the boom structure is moved to cause the said further means to traverse said surface; at least a part of the boom structure, together with the frame or housing, being rotatable about a vertical axis on a turntable; there being means for providing rotational bias thereon, such that the said surface-engaging means can be maintained in engagement with said surface.

An embodiment of the invention will now be described, by way of example only, with reference to the accompanying drawings, in which.

Figure 4:
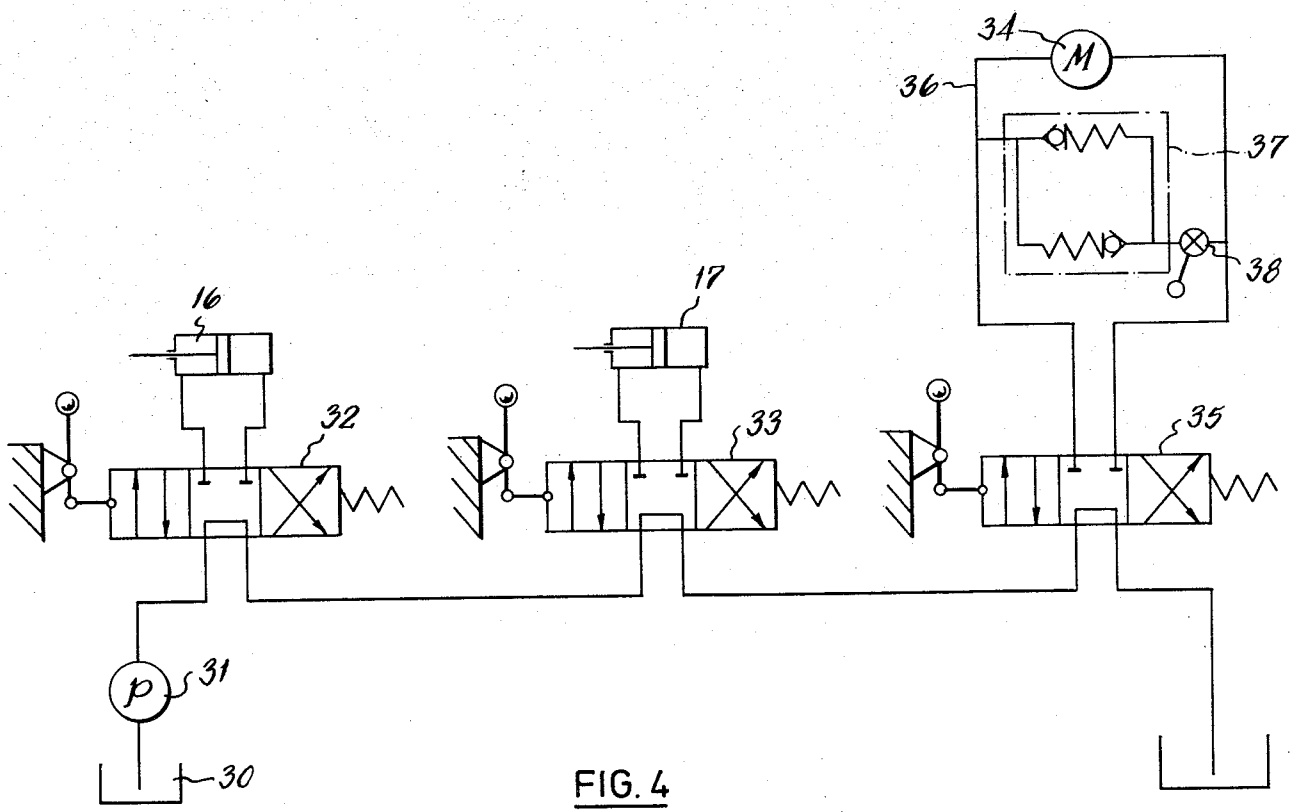

and FIG. 4 is an hydraulic circuit diagram.

Referring now to the drawings, the equipment comprises, in this example, a vehicle 10 having an articulated boom structure generally indicated at 11 mounted thereon about a turntable 12 for rotation about a vertical axis, and pivotably at 13 about a horizontal axis.

The boom structure 11, in the conventional way, comprises a first or lower boom 14 and a second or upper boom 15. The booms are pivotably connected end to end and are capable of elevation by means of hydraulic rams 16 and 17 from a stowed position, shown in dotted lines, wherein the booms are parallel and substantially horizontal, to an elevated position wherein the outermost end of the boom 15 is raised to a position above the vehicle 10, and wherein the booms are substantially aligned.

A cage or personnel-carrying platform 18 is pivotally connected to the outermost end of the upper boom 15, means (not shown) being provided for maintaining the cage 18 level irrespective of the condition of elevation of the boom structure.

Mounted at one side of the cage 18 is a vertical member 19 having a horizontal member 20 attached to its upper end. A frame or housing 21 is pivotally mounted about a horizontal axis on stub axles 22 which are attached to the horizontal member 20 via arms 23, one at each end of the member 20. The housing is pivotable about a vertical axis on the member 19. A plurality of rollers 24 are provided at the front edge of the housing 21 for engagement with the surface 25 of the hull of a ship.

The housing 21 contains treatment means in the form of a nozzle 26 which is connected via a pipe 27 to a supply of pressurised fluid to be directed onto the surface 25 through the open front of the housing 21. The lower part of the housing is formed as a hopper for collection of matter cleaned off the surface 25, which is removed via a pipe 28 and suitable suction means (not shown).

Figure 1:
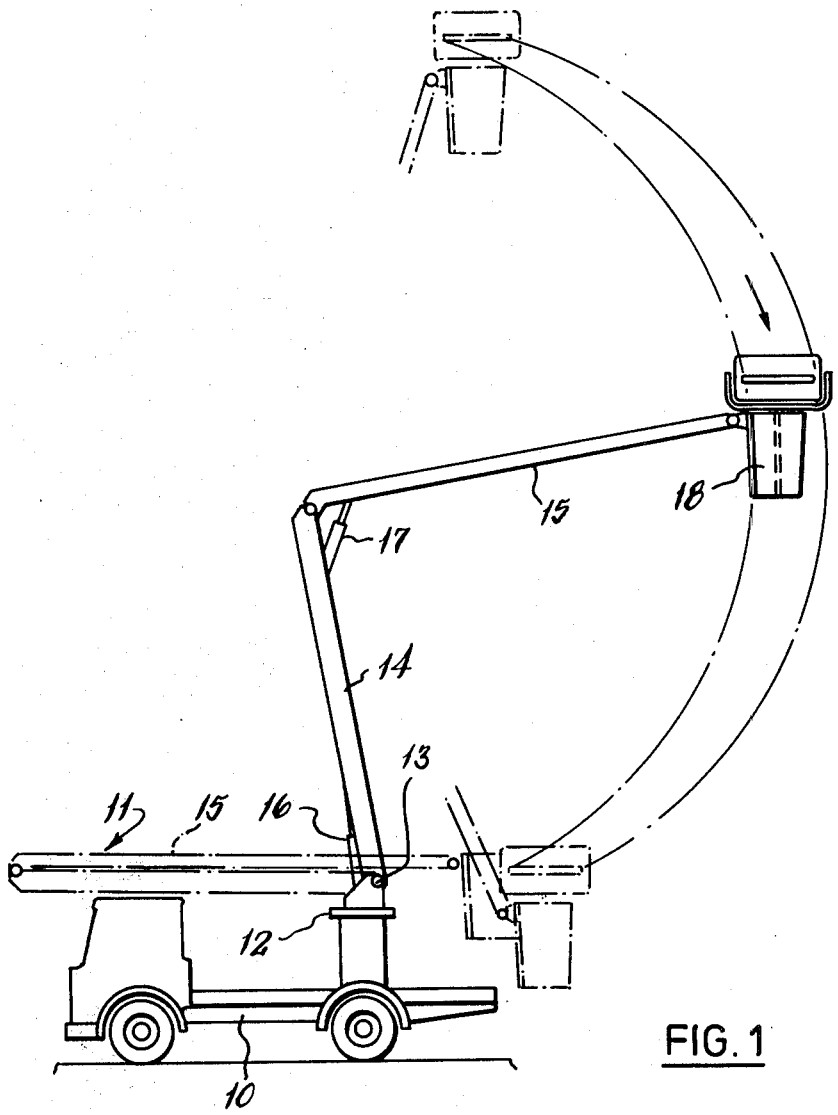
FIG. 1 is a side elevation of the hydraulically operated access equipment to be described.
Figure 3:
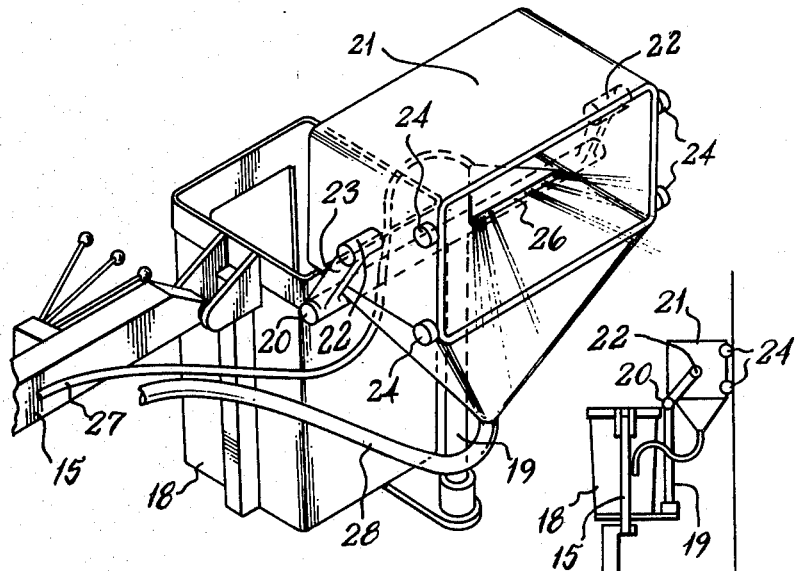
FIG. 3 is a perspective view of frame means located at the outermost end of the boom structure of the equipment, and incorporating means for directing fluid onto said hull.
Figure 2:
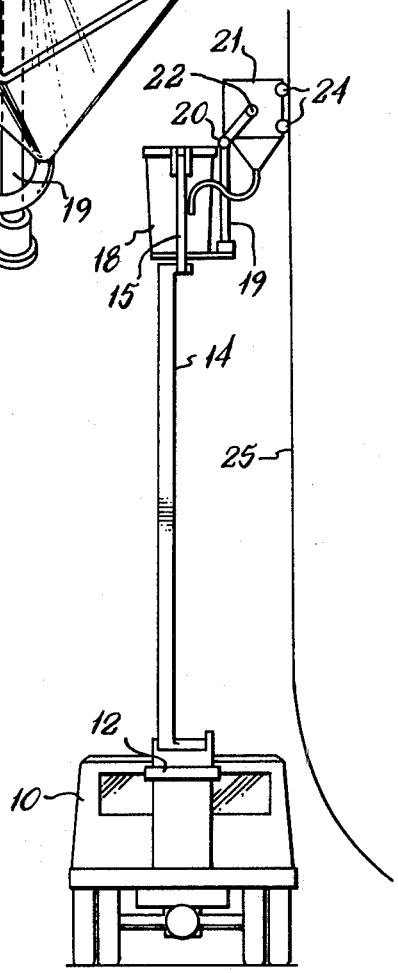
FIG. 2 is a rear end elevation thereof showing the equipment in use and positioned against the hull of a ship in dry dock.

As can be seen from FIG. 1, the equipment in use can be so manoeuvred that for every position occupied by the vehicle 10 along the side of the ship parallel to the surface 25, the outermost end of the boom structure, and thus the nozzle 26, can be made to traverse the surface in a vertical arc. As the vehicle is advanced along said path the whole of the surface 25 can be covered in this way.

It is important that the rollers 24 should be held in contact with the surface 25. Therefore, whilst the turntable 12 is capable of rotation by means of the hydraulic system serving the rams 16 and 17, means are provided, as will be described, for creating a rotational bias on the turntable such that the upper end of the boom structure is urged towards the surface 25. The vertical arc of permitted movement of the cage 18 is so chosen that at its limits of travel its position is sufficiently displaced from the vertical axis of rotation of the turntable that a sufficient radius for rotation still exists therebetween.

Referring therefore to FIG. 4, the hydraulic system comprising a supply reservoir 30 and a pump 31, serves the rams 16 and 17 via adjustable valves 32 and 33 respectively. The system also serves a motor 34 which drives the turntable 12, via a similar valve 35. In a circuit 36 supplying hydraulic fluid to the motor 34, is a by-pass circuit 37 having a valve 38 therein which is manually operable selectively to open the circuit 37 when required. When the valve 38 is open, the fluid supplied to the circuit 36 is divided between the motor 34 and the circuit 37 whereby the motor 34 is caused to rotate whilst being allowed to slip. When the valve 38 is closed the circuit 37 is by-passed so that the full supply of hydraulic fluid is directed to the motor 34.

Therefore, it can be seen that, whichever direction the vehicle 10 is travelling, by operation of the valve 35, with the valve 38 open, the turntable 12 can be biased in rotation to maintain engagement between the rollers 24 and the surface 25.

In conventional equipment of this kind the turntable includes a self-locking device such that when a selected rotational position is attained further rotation is prevented until required, by engagement of the locking device. In the case of the present invention however, the locking device is either omitted or is alternatively disengaged upon opening of the valve 38 thus to enable the turntable to rotate freely as required. Therefore, the rollers 24 are allowed to follow the surface 25 whilst the drive to the turntable 12 maintains engagement thereof.

It is not intended to limit the invention to the above example only, many variations, such as might readily occur to one skilled in the art, being possible without departing from the scope of the invention.

For example, the turntable 12 can be disposed at the knuckle joint between the booms 14 and 15, whereby the equipment is more easily manoeuvred in restricted areas such as the inside of a dry dock.

Additionally, the rotational bias on the turntable can be provided by means adapted to raise the side of the vehicle remote from the surface 25, whilst the turntable is free to rotate, thus to cause the part of the boom structure above the turntable to swing towards, and maintain contact with, the surface.

It will be appreciated that the equipment can be operated by personnel in the cage 18, or alternatively, or additionally, by an operator in the vehicle cab, or on the turntable.

Furthermore, whilst the nozzle 26 has been described as being used to apply cleaning or coating fluids to the surface, there may be provided, alternatively or additionally, other forms or surface treatment equipment such as a vacuum nozzle or scraping means, for example.

What is claimed is:

1. Hydraulically operated access equipment comprising a supporting structure such as a vehicle, a boom structure, a turntable rotatable about a vertical axis on said supporting structure and on which at least a part of said boom structure is pivotally mounted for movement about a horizontal axis, hydraulic actuating means for said boom structure whereby the boom structure may be moved about its horizontal pivot between a generally horizontal stowed position on said supporting structure and an elevated position wherein its outermost end is raised above said supporting structure, a frame or housing mounted on said boom structure at the outermost end thereof, treatment means carried by said frame or housing for cleaning or applying a coating to an adjacent surface, means in said hydraulic actuating means effective to swing said boom structure to cause said treatment means to traverse said surface in substantially vertical arc paths, surface-engaging means on said frame or housing adapted to maintain said frame or housing at a fixed distance from said surface when the equipment is in use and as said boom structure is moved to cause said treatment means to traverse said surface, and means for imparting a continuous rotational drive to said vertical axis turntable during movement of said treatment means in said paths whereby to continuously bias said boom structure and frame or housing means toward said surface to thereby positively cause said surface-engaging means to be maintained in contact with said surface during all operational movement of said treatment means in said paths, said means for imparting a continuous rotational drive to said vertical axis turntable further comprising means to permit the means for imparting the rotational drive to slip during operation.

2. Hydraulically operated access equipment according to claim 1, wherein said frame or housing is mounted to be pivotable relative to the boom structure about horizontal and vertical axes.

3. Hydraulically operated access equipment according to claim 1, wherein said treatment means comprises nozzle means carried by said frame or housing and directed towards an opening therein.

4. Hydraulically operated access equipment according to claim 1, wherein the said treatment means is disposed within said frame or housing and said surface-engaging means comprises a plurality of rollers mounted at one edge of the frame or housing which is to be the edge adjacent the surface to be engaged.

5. Hydraulically operated access equipment according to claim 1, wherein said means for imparting said rotational drive to the turntable comprises an hydraulic motor for driving the turntable in rotation said slip means comprising selectable means to permit the motor to slip during rotation.

6. Hydraulically operated access equipment according to claim 5, wherein said motor is hydraulically operated through a supply system, there being a by-pass circuit in the supply system to said motor, and a valve in said by-pass enabling hydraulic fluid supplied to said motor to be partially diverted therefrom.

7. Hydraulically operated access equipment according to claim 1, wherein said boom structure comprises a plurality of articulated booms pivotally connected end-to-end, the lowermost end of the lowermost boom being pivotally mounted on the turntable which is rotatably mounted on a vehicle.

8. Hydraulically operated access equipment according to claim 1, wherein said frame or housing includes a hopper for collecting matter removed from said surface and for disposal of same via suction means connected thereto.

* * * * *